US006289798B1

(12) United States Patent
Van Der Hyde

(10) Patent No.: US 6,289,798 B1
(45) Date of Patent: Sep. 18, 2001

(54) METHOD AND APPARATUS FOR BALING TOBACCO AND OTHER MATERIALS

(76) Inventor: Daniel W. Van Der Hyde, 960 Davis Rd., Chatham, VA (US) 24531

( * ) Notice: Subject to any disclaimer, the term of this patent is extended or adjusted under 35 U.S.C. 154(b) by 0 days.

(21) Appl. No.: 09/391,108

(22) Filed: Sep. 7, 1999

(51) Int. Cl.[7] ..... B30B 9/30; B30B 7/04

(52) U.S. Cl. ..... 100/42; 100/100; 100/232; 100/233; 100/249; 100/255

(58) Field of Search ..... 100/42, 100, 190, 100/215, 218, 232, 233, 249, 250, 255; 56/27.5, 346

(56) References Cited

U.S. PATENT DOCUMENTS

| | | | | |
|---|---|---|---|---|
| 199,360 | * | 1/1878 | Ertel | 100/255 |
| 525,203 | * | 8/1894 | Gray | 100/250 |
| 623,394 | * | 4/1899 | Burner | 100/255 |
| 2,932,244 | * | 4/1960 | Moyer | 100/100 |
| 3,839,852 | * | 10/1974 | Jebens | 100/100 |
| 4,412,410 | * | 11/1983 | Smith, Jr. | 100/255 |

FOREIGN PATENT DOCUMENTS

| | | | | |
|---|---|---|---|---|
| 232671 | * | 2/1986 | (DE) | 100/218 |
| 176910 | * | 3/1922 | (GB) | 100/232 |
| 2172844 | * | 10/1986 | (GB) | 100/255 |

* cited by examiner

*Primary Examiner*—Stephen F. Gerrity
(74) *Attorney, Agent, or Firm*—Coats & Bennett, PLLC

(57) ABSTRACT

A baling machine for baling tobacco and other materials. The baling machine includes a bale chamber that includes a bottom, opposed ends, a ram assembly, and a pair of opposed side and top assemblies. Each side and top assembly is pivotally mounted adjacent the floor of the bale chamber and movable from a closed position to an open position. In the closed position each side and top assembly extends around the bale chamber and forms a part thereof. In the open position, each side and top assembly extends outwardly from the bale chamber and effectively leaves the bale chamber open from the top, thereby enabling tobacco to be fed into the bale chamber from the top. Once the bale chamber has been filled, the side and top assemblies are closed and the ram assembly pushed through the bale chamber causing the tobacco therein to be compressed and formed into a bale. Thereafter, the bale is either ejected or removed from the bale chamber.

40 Claims, 7 Drawing Sheets

METHOD AND APPARATUS FOR BALING TOBACCO AND OTHER MATERIALS

FIELD OF THE INVENTION

The present invention relates to a baling machine and more particularly to a baling machine for baling cured and dried tobacco.

BACKGROUND OF THE INVENTION

After tobacco is cured and dried, in the past it has typically been placed in loose form in sheets and transported to market. Prior to being sheeted, the tobacco is held within tobacco racks or large containers within bulk tobacco barns. In emptying the barns, the tobacco within the racks and containers are placed in the sheets and the sheets are tied up and loaded onto a truck that transports the sheeted tobacco to market. This basic method of handling cured and dried tobacco between the farm and the market has been used for approximately thirty to forty years. However, it has some serious drawbacks and disadvantages. First this system of handling and transporting cured and dried tobacco is very labor intensive. In addition, handling cured and dried tobacco in sheets results in significant losses due to the tobacco falling out of the sheets between the farm and a warehouse where the tobacco is sold. Finally, transportation costs are also a concern. Since the tobacco is not compressed or packed within the sheets, then it follows that the tobacco assumes a relatively large volume and that in turn means that transportation costs can be substantial.

In recent years, there has been a trend towards baling cured and dried tobacco. Tobacco balers are now being used at both farm and market sites. The loose leaf cured and dried tobacco is typically removed from racks and containers and fed into a baler. The baler compresses the tobacco into cubes and the cubes of compressed tobacco are tied with wire and finally ejected or removed from the baler.

There are a number of baler designs being used to bale tobacco. Essentially, all of the balers include a baling chamber and a reciprocating ram that moves back and forth through the baling chamber to compress the loose tobacco. However, the baling machines that are used today to bale tobacco have a number of drawbacks and disadvantages. Principally among the disadvantages is that these balers are difficult and time consuming to load. For example, a number of balers that are presently being used to bale cured and dried tobacco include fixed upright side walls that tend to extend to such a height that it is difficult for individuals to hand feed the tobacco into the baling chamber. Consequently loading the baler is slow and that in turn translates to an inefficient and costly baling operation.

Therefore, there has been and continues to be a need for a tobacco baling machine that is easy to load and which has the capacity to produce a relatively large output of tobacco bales.

SUMMARY OF THE INVENTION

The present invention entails a baler for baling tobacco and other materials. The baler includes a baling chamber supported on a main frame structure. Forming a part of the baling chamber is at least one moveable side and top assembly. During the actual baling operation, the moveable side and top assembly forms a side and at least a portion of the top of the bale chamber. However, in loading the bale chamber, the side and top assembly is movable from the closed position to an open position, leaving the bale chamber open in order that material can be fed or delivered into the chamber. Once the baling chamber has been filled with material to be baled, the side and top assembly is moved from the open position back to the closed position where the side and top assembly form a side and at least a portion of the top of the baling chamber. In the embodiment illustrated herein, the side and top assembly is pivotally mounted on the baler and includes a side wall or panel and a top panel with the top panel being pivotally connected to the side wall. Thus, it is appreciated that the entire assembly can be pivoted back and forth between the closed and open positions and at the same time the top panel can be pivoted back and forth with respect to the side panel. Thus, for example, in loading the bale chamber, the top panel of the assembly can be pivoted to where it extends generally coplanar with the side wall and together the side wall and top panel can be pivoted outwardly to where the side and at least portions of the top of the bale chamber are open for feeding.

Further, in a preferred embodiment, the baler of the present invention includes a pair of opposed side and top assemblies that work together such that when both assemblies are closed, they together form both sides and the top of the bale chamber. As with the embodiment discussed above, both of the side and top assemblies are pivotally mounted on the baler while the top panels of the assembly are pivotally mounted with respect to the side walls. In this embodiment, the top panel of each assembly comprises approximately one-half of the top of the bale chamber when the assemblies assume the closed position.

To secure the side and top assemblies in place when they assume the closed position, there is provided an interlocking structure for securing the side and top assemblies to end structures disposed on opposite ends of the bale chamber. Essentially, when the side and top assemblies are rotated into the closed position, there is provided a series of latches that extend from the end retaining structures and which interlock with the side and top panels of the assemblies. Thus it is appreciated, that in the closed positions, the side and top assemblies, along with a floor area, form a rectangular and rigid bale chamber. In a preferred embodiment, secured to one end retaining structure is an end door that is movable between an open and closed position. In the closed position, the end door forms the end of the bale chamber. Opposite the end door, is an opening through which a ram assembly moves. The ram assembly is designed to reciprocate back and forth and to compress tobacco or other material between the ram and the end door when the door assumes the closed position.

Once a bale has been formed in the bale chamber, the side and top assemblies are rotated outwardly towards their open position. The end door is opened and the ram is extended substantially through the bale chamber, engaging the formed bale and pushing the bale through the open end of the bale chamber. To facilitate removing the bale from the bale chamber, there can be provided a series of rollers formed in the floor of the bale chamber adjacent the bale exit end of the chamber. By utilizing the rollers, the formed bales can be removed from the bale chamber without the assistance of the ram assembly.

The present invention also entails a method of baling tobacco and other materials. In this regard, at least one side and top assembly can be rotated or moved outwardly from the bale chamber so as to leave the bale chamber open. Once the side and top assembly has been rotated outwardly, individuals can hand feed the baler or a mechanical feeding system can be appropriately aligned to where the tobacco or other material is conveyed over the edge of the side and top assembly into the bale chamber. After the bale chamber has been filled, the side and top assembly is closed and the baling operation proceeds.

Other objects and advantages of the present invention will become apparent and obvious from a study of the following description and the accompanying drawings which are merely illustrative of such invention.

DETAILED DESCRIPTION OF THE INVENTION

With further reference to the drawings, a baler is shown therein and indicated generally by the numeral 10. As will be appreciated from subsequent portions of this disclosure, baler 10 is designed to bale tobacco and other materials.

Figure 2:
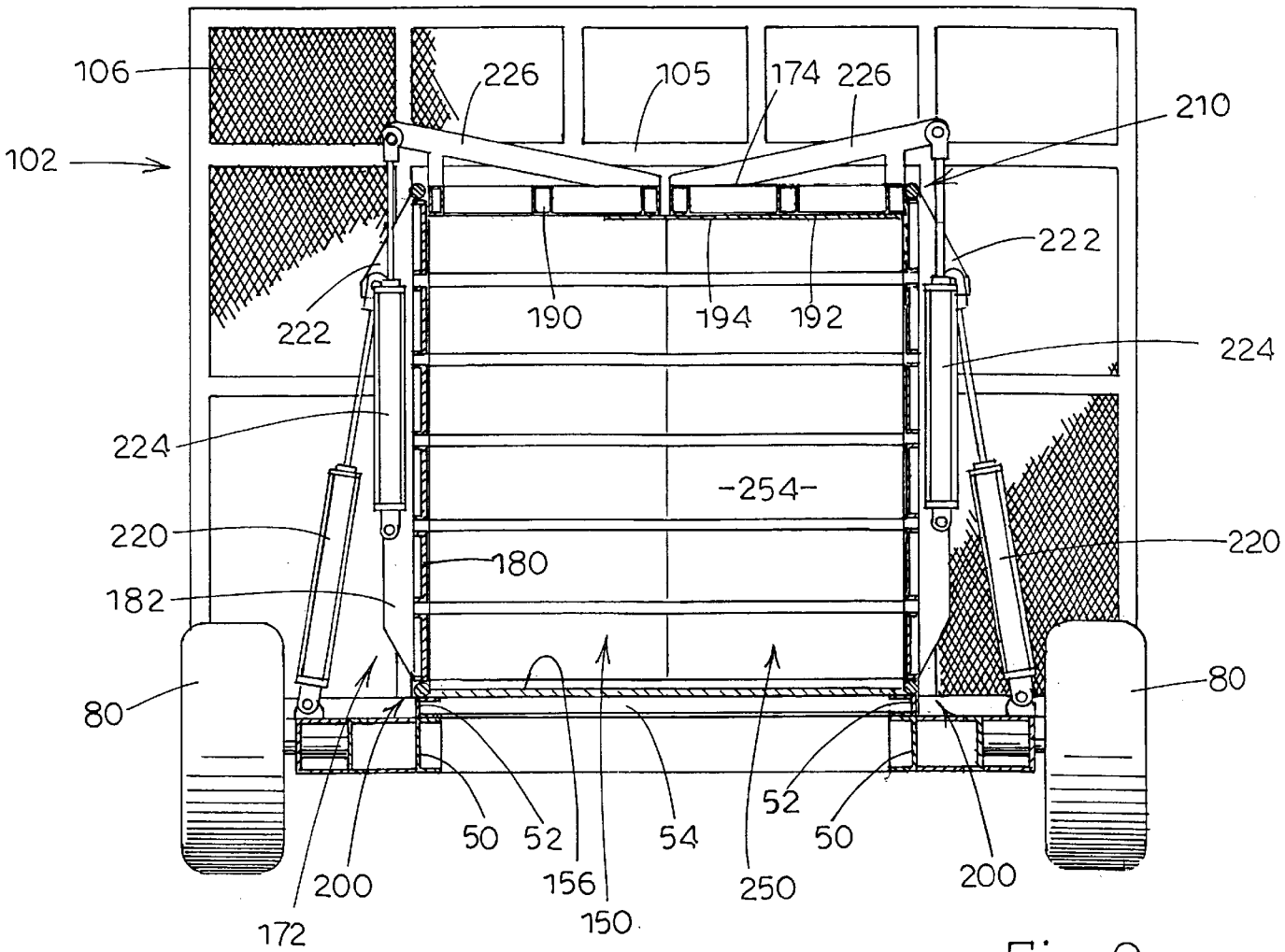
FIG. 2 is a transverse sectional view of the baler of the present invention shown with the two side and top assemblies in their closed position.

Baler 10 comprises a main frame structure that includes a pair of central channel members 50 that extend longitudinally from one end of the baler 10 to the other end (FIG. 2). Mounted on each central channel member 50 is an upper angle iron member 52. Interconnected between the spaced apart angle iron members 52 is a series of longitudinally spaced cross members 54. Each cross member 54 in this embodiment comprises a piece of angle iron that is oriented such that it assumes a generally v-shaped cross section as it extends between the upper chamber 52.

Figure 3:
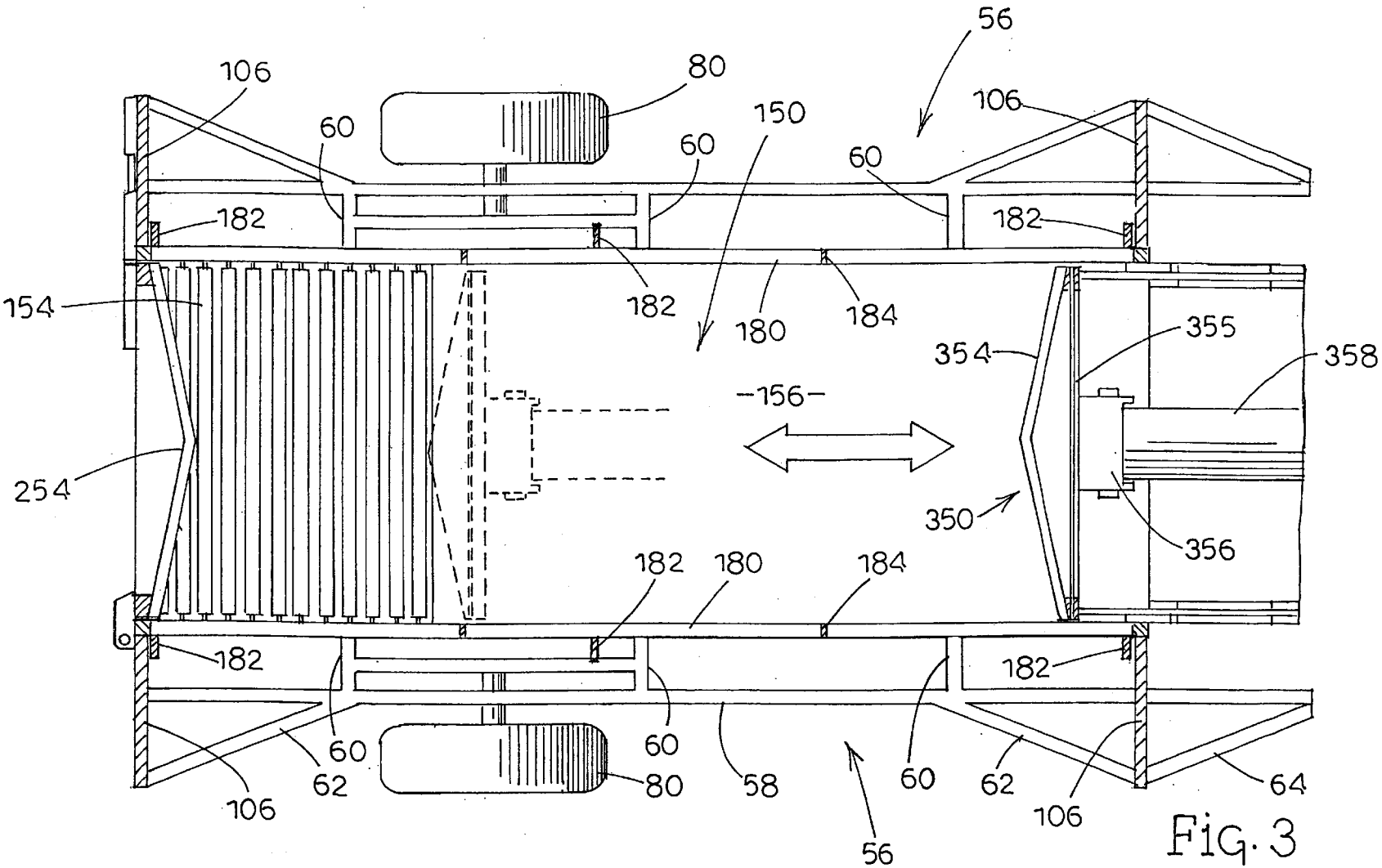
FIG. 3 is a top sectional view of a portion of the baler.

Also forming a part of the main frame structure is an outboard frame network, indicated by the numeral 56 that is disposed on each side of the baler. This outside frame structure is particularly shown in FIG. 3 and as seen therein includes a longitudinal member 58 and a series of transverse members 60. In addition, disposed about the front and rear ends of the outboard frame structure 56 is a pair of diagonal end members 62. Further, extending forwardly from the outboard frame structure 56 on each side of the baler is a pair of front diagonal members 64 that extend to the front portion of the baler and connect to a clevis 66 that is adapted to connect the baler to a tractor or other prime mover. Disposed adjacent the clevis 66 is a jack for supporting the front of the baler 10.

As appreciated from the drawings, the baler 10 of the present invention is portable and can be moved from one location to another location. Consequently, the baler 10 includes a pair of wheel 80, each wheel 80 being connected to the outboard frame structure 56.

Mounted to the main frame structure about opposite ends of the baler is an end retaining frame or structure. The end retaining frames includes a front retaining frame 100 and a rear retaining frame 102. As seen in the drawings, these retaining frames are longitudinally spaced apart and as will be appreciated from subsequent portions of the disclosure, the baling chamber, to be hereafter described, extends generally between these two retaining frames 100 and 102. Each of the retaining frames 100 and 102 includes a rectangular or square opening 104 that is surrounded by a rectangular frame 105. Further each of the end retaining frames 100 and 102 includes a retaining screen 106.

Mounted on the main frame structure is a longitudinal baling chamber or bale chamber indicated generally by the numeral 150. As seen in the drawings, baling chamber 150 is generally rectangular or square in cross section and comprises a floor 156. As seen in FIG. 2, the floor 156 is supported by the series of longitudinally spaced angle iron members 54 that extend generally between the upper angle iron members 52. Also, in one embodiment, formed in the rear portion of the floor 156 is a series of transverse rollers 154. These rollers 154 are contemplated to be freewheeling but it will be understood by those skilled in the art that the rear rollers could be powered. Again as will be appreciated from subsequent portions of this disclosure, the rollers 154 facilitate the removal of baled material from the baling chamber. In lieu of the rollers, the floor 156 may simply extend throughout the bale chamber. As will be appreciated from subsequent portions of the disclosure, with this design, a ram assembly can be utilized to push a formed bale from the rear end of the bale chamber.

As seen in the drawings, the baling chamber also includes a surrounding side and top structure. In fact, as the drawings illustrate, the surrounding side and top structure of the baling chamber includes a pair of opposed sides and a top. In the case of the embodiment illustrated herein, this surrounding side and top structure is formed by a pair of side and top assemblies, each being indicated generally by the numeral 170. Each side and top assembly including two main components, a side wall indicated generally by the numeral 172 and a top panel or top portion indicated generally by the numeral 174.

Figure 4:
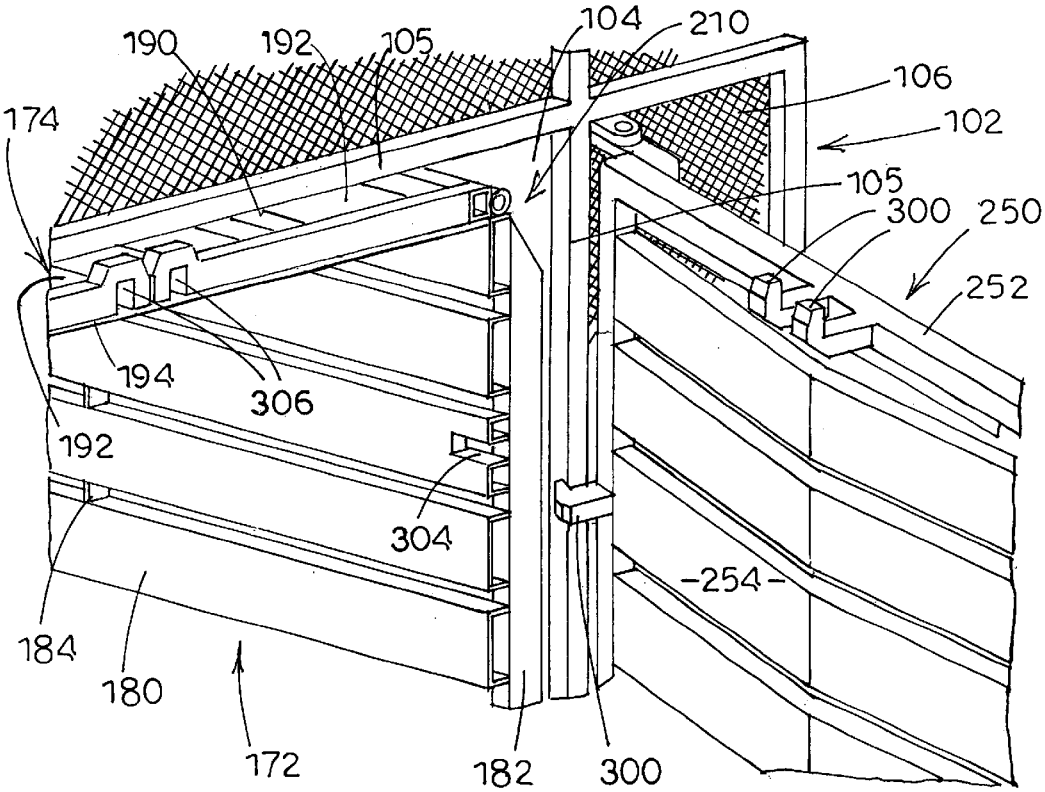
FIG. 4 is a fragmentary perspective view illustrating the end door of the bale chamber disposed in an open position.

Turning first to the side wall 172, it is seen that the same includes a series of elongated side channel members 180 that are secured interiorally to a series of transverse members 182. Note in the embodiment illustrated that there are three spaced apart transverse members 182, a front transverse member, a back transverse member, and an intermediate transverse member. Again, the transverse members 182 are secured by weldment or other suitable means to the respective side channel members 180. In addition, secured between respective side channel members 180 are a series of gussets or spacers 184 (FIG. 4). Thus it is appreciated that the side wall 172 is a composite or unitary structure comprised of the side channel members 180, the transverse members 182 and the gussets or spacers 184.

Now turning to the top panel 174, it is seen that the same includes a basic rectangular frame 190 made of tubular stock. Secured to the back of the rectangular frame 190 is a backing 192 that is constructed of sheet metal or the like. At this point it should be pointed out that one of the top panels 174 is provided with a lip extension 194 (FIGS. 2 and 4). In the closed position when the pair of side and top assemblies 170 form portions of the bale chamber, it is seen that the lip extension 194 from one top panel extends underneath a portion of the other top panel 174.

Figure 1:
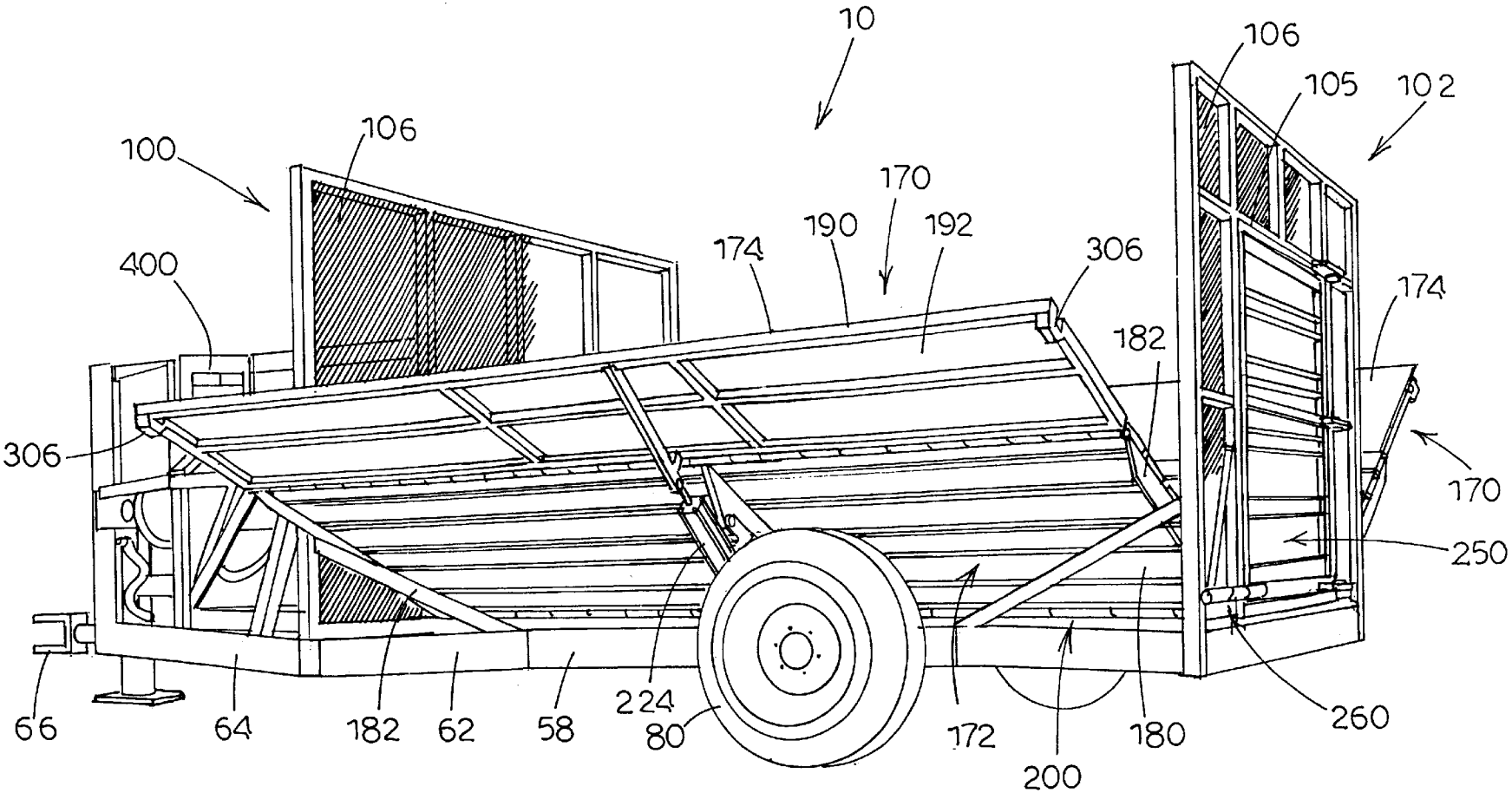
FIG. 1 is a perspective view of the baler of the present invention shown in a loading mode.

Each of the side and top assemblies 170 are movable between a closed position (FIG. 2) and an open position (FIG. 1). In the closed position it is seen that the two side and top assemblies 170 form a part of the wall structure of the bale chamber 150. In the extended or open position, the side and top assemblies 170 are moved outwardly away from the bale chamber and leave the bale chamber open on the side and at the top to permit tobacco or other material to be fed therethrough. In order to accommodate this movement, each side and top assembly 170 is pivotally mounted through a hinge structure to the frame structure of the baler, and moreover the top panel or top portion 174 of the assembly is pivotally connected to the side wall 172. More particularly, each side wall 172 is hinged to the main frame of the baler through a hinge structure indicated generally by the numeral 200. Hinge 200 includes a series of hinge sleeves. The sleeves, in alternating fashion, are connected to the main frame of the baler and to the lower portion of the adjacent side wall 172. The hinge connection is completed by an elongated pin that is secured within the respective pin sleeves.

A like hinge structure 210 is employed to hinge the side wall 172 and the top panel 174 of each assembly 170. Again, the hinge 210 comprises a series of hinge sleeves. The sleeves in alternating fashion, are connected to the upper edge of the side wall 172 and to an adjacent edge of the top panel 174. An elongated hinge pin extends through the hinge sleeves and is pinned therein to form the hinge structure.

Both the side wall 172 and top panel 174 of each assembly 170 is actuated by a double acting hydraulic cylinder. More particularly, there is provided a side wall cylinder 220 that is disposed on each side of the baler for pivoting the respective side walls 172 about hinge 200. Note that the side wall cylinder 220 is connected or anchored to the adjacent outboard frame structure 56 and extends upwardly therefrom where the rod end of the cylinder connects to an upper clevis or bracket 222 that extends from the intermediate transverse member 82 of the side wall 172. It should be appreciated that the base of each side wall cylinder 220 is connected to the outboard frame structure 56 such that the entire cylinder may rotate clockwise or counter clockwise (as viewed in FIG. 2) as the respective side and top assembly 170 is moved back and forth between its open and closed position. Thus, it is appreciated that the anchor end or base end of the side wall cylinder 220 is pivotally connected to the outboard frame structure 56.

In similar fashion there is provided on each side of the baler, a top panel cylinder 224. Cylinder 224 is anchored to a respective side wall 172 and the rod end thereof extends upwardly to where it connects to a transverse arm 226 that extends downwardly and connects to the underlying top panel 174. As noted above, both cylinders 220 and 224 are double acting cylinders. It is appreciated that cylinder 220 is operative to move both the side wall 172 and top panel 174 while cylinder 224 is simply operative to pivot or move the top panel 174 with respect to the side panel 172.

Secured to the rear end of the baling chamber 150 is an end door 250 (FIGS. 2 and 4). The end door is hinged to the surrounding frame 105 that forms a part of the rear retaining frame 102. Viewing the door 250 more detailed, it is seen that the same includes an outer surrounding frame 252 and a series of transverse members 254 that extend across the outer frame 252. Note in the embodiment illustrated herein, that series of a transverse member 254 assume a generally v-shaped configuration and wherein due to that shape the respective transverse members 254 tend to project inwardly into the bale chamber 150. As will be appreciated from the subsequent portions of the disclosure, the shape of the transverse members 254 will impart a like shape to the material being baled within the bale chamber 150.

Figure 4A:
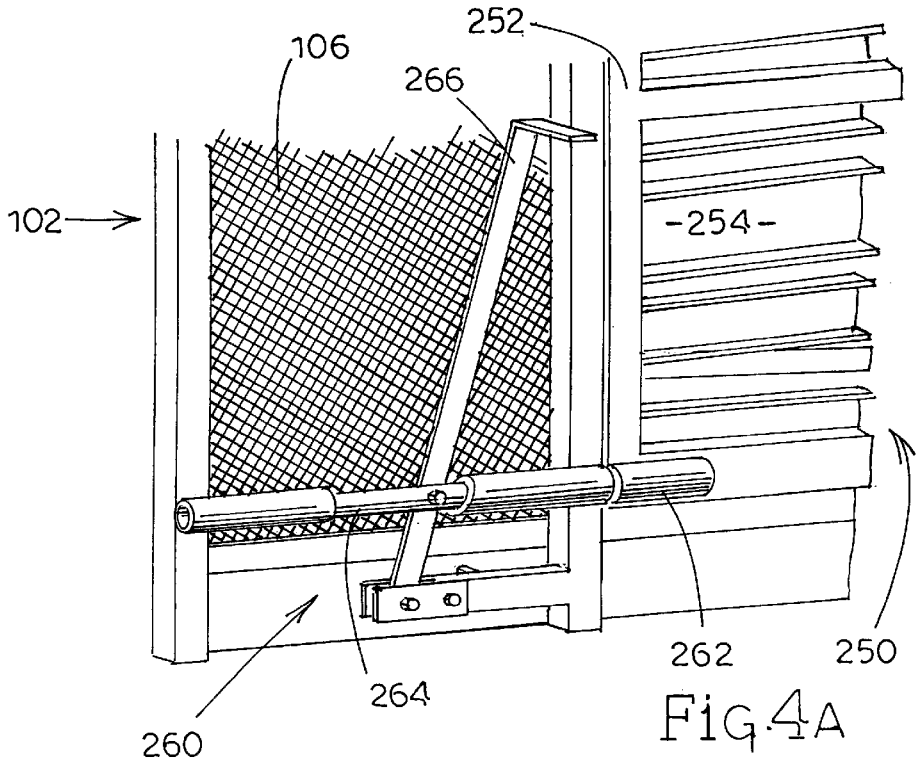
FIG. 4A is a fragmentary perspective view illustrating the latch assembly that locks the end door in a locked position.

End door 250 is movable between a closed position and an open position. In the closed position end door 250 forms the end wall of the baling chamber 150. To secure the end door in the closed position, there is provided a latch assembly indicated generally by the numeral 260 (FIG. 4A). The latch assembly 260 is mounted adjacent the end door 250 and on the rear retaining frame structure 102. As shown in FIG. 4A, the latch assembly 260 includes a locking sleeve 262 that is secured to the outside of the end door 252 and a reciprocating latch pin 264 which can be driven back and forth between latched and unlatched positions by an elongated lever arm 266.

Figure 5A:
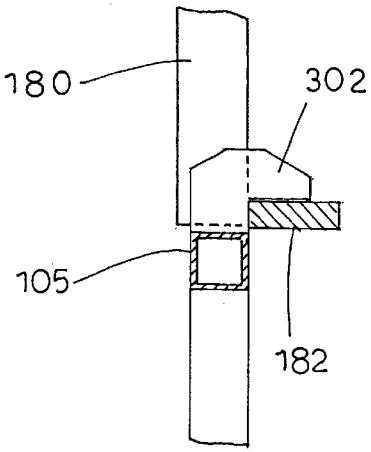
FIG. 5A is a fragmentary detail view illustrating how a side wall of the baler interlocks with a front end frame structure.

In the embodiment illustrated, when the side and top assemblies 170 are disposed in their closed position, the side and top structure of these assemblies can be firmly fixed, at least in the longitudinal direction, to form a rigid bale chamber. Thus the present invention provides an interlocking structure that essentially locks the two side and top assemblies 170 to the front and rear retaining frames 100 and 102 or to structure associated therewith. More particularly, the rear portions or ends of the side and top assemblies 170 is secured to the end door 250 by a series of four latches 300 (FIG. 4) that project inwardly from the door when the same assumes the closed position. Note that the latches 300 include two closely spaced upper latches and a pair of side latches (only one of which is shown). About the opposite end of the bale chamber 150, there is provided a series of four front latches 302. The front latches 302 project rearwardly from the surrounding frame 105 that forms a part of the front retaining frame 100. Here again, the front latches 302 include four latches, two closely spaced upper latches and two side latches. As seen in FIG. 5A, the respective front latches 302 project inwardly from the surrounding frame structure 105. When the adjacent side wall 172 assumes the closed position, the latch 302, which happens to be a front side latch, extends transversely through an opening in the side wall 172 and abuts against the end transverse member 182. In the case of both sets of latches, they project inwardly into the bale chamber and interlock with the side walls 172 and top panels 174 of the side and top assemblies 170.

To receive and hold certain of the latches 300 and 302, each side wall 172 about its respective ends includes a side wall catch 304 (FIG. 4). Likewise, each of the top panels 174 about opposite ends includes a top catch 306. The top catches 306 are designed to receive the two top latches 300 that projected inwardly from the end door 250 and the two top front latches (not shown) that project inwardly from the surrounding frame 105 of the front end retaining frame 100.

As seen in the drawings, when the end door 250 assumes the closed position, all of the latches 300 and 302 are designed to align with the side wall and top catches 304 and 306 associated with the side and top assemblies 172. Thus once the respective side and top assemblies have been rotated inwardly to their closed positions, it is appreciated that the respective latches 300 and 302 will project into and lock with the respective catches 304 and 306. The interlocking structure just described aims at stabilizing and locking the side and top assemblies 170 in both the longitudinal and transverse directions. That is, when the side and top assemblies 172 assume the closed position, they are secured in both the longitudinal and transverse directions. This is because in the closed position, the upper latches extend into the catches 306 formed in the top panels 174. Thus the side and top panel assemblies are prevented from rotating outwardly because of this lock relationship. In order to move the top and side assemblies from the closed position to the open position, it is first necessary to unlatch the top panels 174. This is accomplished by first rotating the top panel 174, without the lip extension 194, outwardly. Next the other top panel is rotated outwardly, thereby unlocking the top panels from the frame structure of the baler. Thereafter, the entire side and top assemblies can be rotated to their outer open positions.

Figure 5:
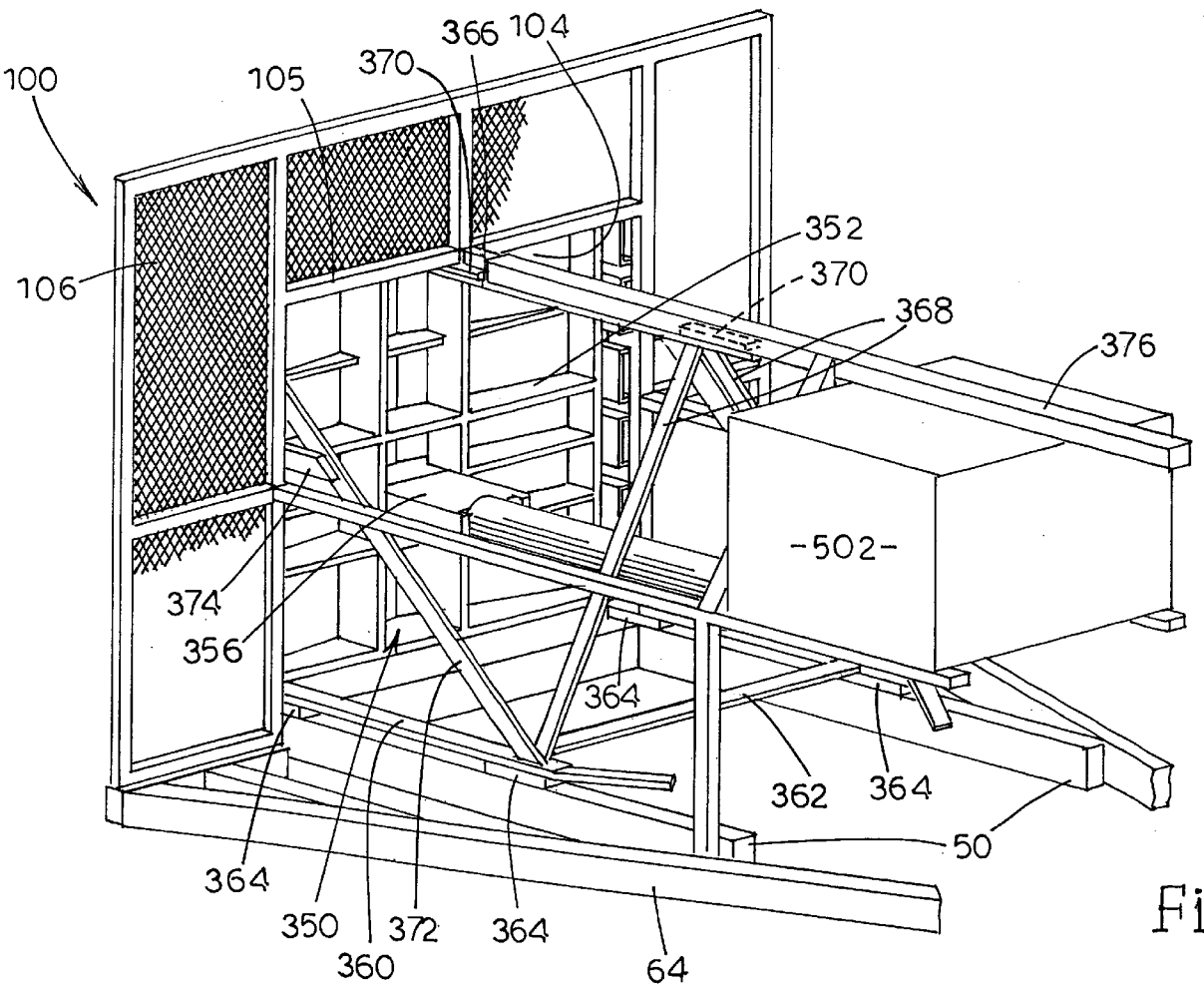
FIG. 5 is a fragmentary perspective view showing a front end portion of the baler and the ram assembly.

The baler 10 of the present invention includes a ram assembly, indicated generally by the numeral 350, that is reciprocally mounted for back and forth movement through the bale chamber 150. Ram assembly 350 is particularly shown in FIGS. 3 and 5 and includes a head portion that comprises a central frame structure 352 that is made up of a series of vertical and transverse frame members. Formed on the rear side of the central frame 352 and facing the end door 250 is a face that comprises a plurality of transverse cross members 354. Each of the cross members 354 includes a v-shaped configuration with the apex of the v being directed inwardly towards the bale chamber in a manner like the transverse members 254 of the end door 250. Thus it is appreciated that the ram assembly 350 will make a v-shaped imprint or configuration in the material being baled due to the shape of the face of the ram assembly.

Secured to the front side of the central frame 352 is a cylinder connecting block 356. Secured to the cylinder connecting block 356 is an elongated multi-stage hydraulic cylinder 358. Hydraulic cylinder 358 extends forwardly from the head of the ram assembly and is anchored about the front portion of the baler.

Projecting forwardly from the central frame 352 of the ram assembly is a guide structure that tends to guide the ram assembly 350 as it is reciprocated back and forth within the baling chamber 150. Viewing this guide structure in more detail, the same includes a pair of lower guide members 300 that are secured to the central frame 352 and project forwardly therefrom over the central channel members 50 of the main frame. Connected between the lower guide members 360 is a cross member 362. To facilitate the sliding of the ram assembly back and forth, there is provided a pair of nylon surfaced sliding blocks 364 underneath each lower guide member 360. More specifically, the pair of nylon sliding blocks 364 are secured to the underside of the lower guide members 360 and slide on the upper surface of the central channel members 50.

Additional guiding is provided by a central upper guide member 366 that is secured to the central frame 352 and projects forwardly therefrom through a central guide channel 376 that forms a part of an open frame structure disposed about the front portion of the baler and particularly extending forwardly from the front end retaining frame 100. Again to facilitate the sliding of the ram assembly, there is provided a pair of nylon sliding blocks 370 secured to the upper surface of the central guide 366. The central guide 366 is supported by a pair of transverse diagonal braces 368 that extend downwardly from the central guide member 366 and connect to the lower guide members 360.

In addition, the forwardly projecting guide structure includes a pair of longitudinal diagonal members 372 that are secured to the central frame 352 and project generally forwardly and downwardly therefrom to where they too connect to the lower guide members 360. Secured to the outside of the diagonal braces 372 is a pair of sliding blocks 374 that include an outer exposed nylon sliding surface.

Therefore, it is appreciated that as the ram assembly 350 is reciprocated back and forth within bale chamber, that the series of nylon sliding blocks 364, 370, and 374, engage the inner surfaces of the bale chamber structure and facilitate the sliding of the ram assembly while at the same time generally guiding the head of the ram assembly 350 and maintaining it in proper alignment as it is moved back and forth.

The baler 10 is also provided with a scale system for weighing the tobacco or other materials that are being baled. As shown in FIG. 1, an electronic scale system is incorporated into the baler and there is provided a control panel 400 about the front of the baler that is operatively connected to a series of weight sensors (not shown) that are incorporated into the main frame structure of the baler. More particularly, the weight sensors are disposed in or about the hubs of the respective wheels and in conjunction with the front clevis 66. During the baling operation, the scales can be effectively zeroed and as material is added to the baling chamber, the scales will indicated the weight of the material being loaded into the bale chamber. Thus bales of a particular weight can be consistently produced by the baler of the present invention.

Figure 7:
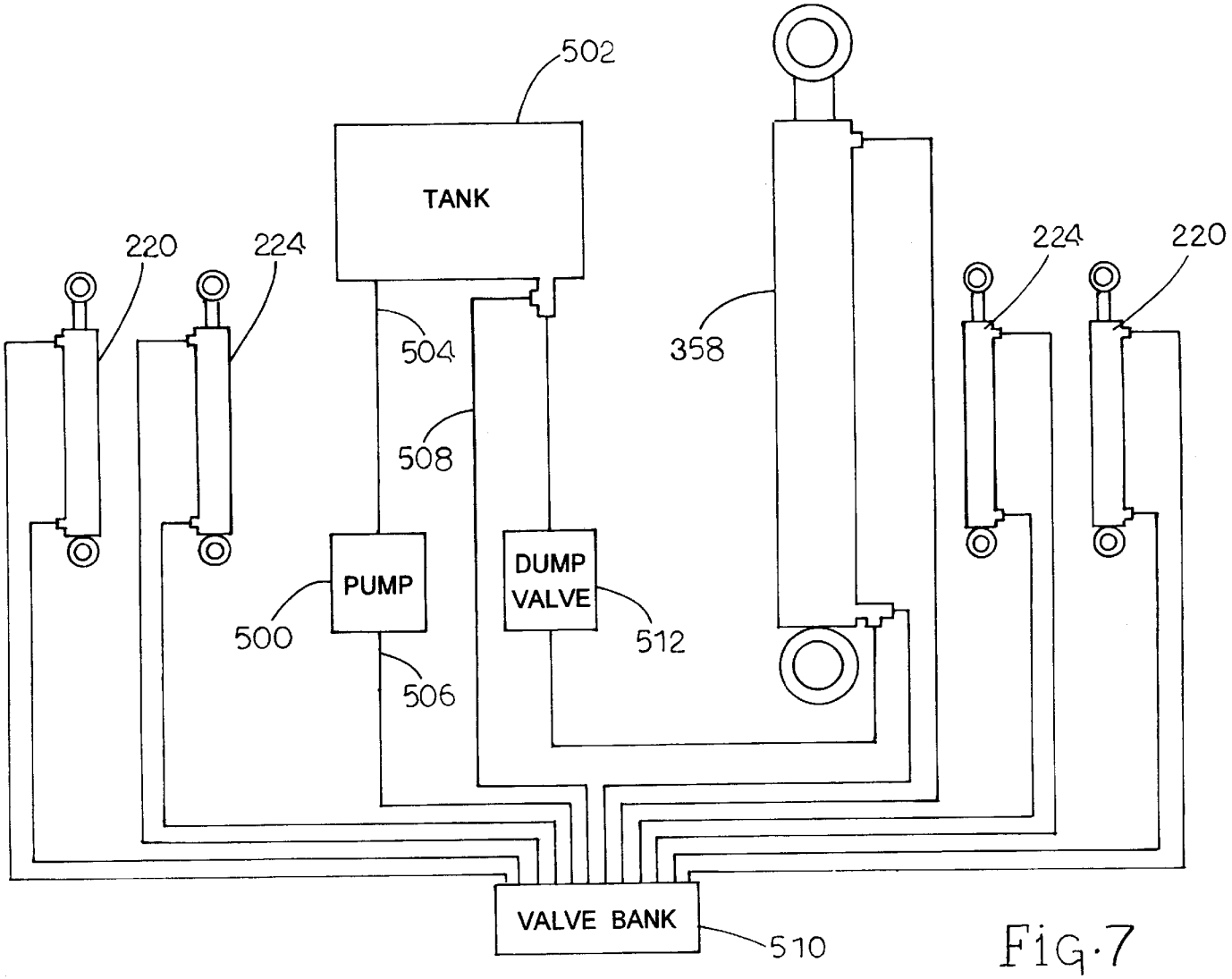
FIG. 7 is a schematic illustration of the hydraulic system of the present invention.

With reference to FIG. 7, there is shown therein a schematic of the hydraulic system for powering the baler 10 of the present invention. The hydraulic system includes a pump 500 that is operative to pump hydraulic fluid from a tank 502 through line 504. The pump 500 may be powered by the power take off of a tractor or may be a self-powered pump. Extending from the pump 500 is a pressure line 506 that leads to a valve bank 510. In the case of the present invention, valve bank 510 includes a series of five control levers and is operative to control five hydraulic cylinders including the two side wall cylinders 220, the two top panel cylinders 224 and the ram cylinder 358. In addition, the valve bank 510 would include an integral relief valve to protect against pressure overload. Because of the size of the ram cylinder 358, it is desired that the system be capable of dumping hydraulic fluid therefrom at a substantial rate. Accordingly, the hydraulic system includes a dump valve 512 that is connected to the ram cylinder 358 such that when the cylinder is in a retract mode, the dump valve 512 is actuated allowing hydraulic fluid to be expeditiously evacuated from cylinder 358 since the dump valve 512 permits the exiting hydraulic fluid to by-pass the valve bank 510.

As will be appreciated from subsequent portions of the disclosure, once a bale of material is formed, it is tied with a series of wires W (FIG. 6) that are extended around the formed bale. In order to position the respective wires W around the bale, the face of the ram assembly 350 is provided with a series vertically spaced of wire guides 355. Note in FIG. 6 where the wire guides 355 are spaced between the plurality of v-shaped cross members 354 that form the face of the ram assembly. Formed on the outer side of the wire guides 355 is an open slot. The open slot allows the wire W inserted within the wire guide to escape once the ram assembly 350 is retracted from the formed bale.

In operation, to load the baler 10, the two side and top assemblies 170 are moved or rotated to their outer open position shown in FIG. 1. To accomplish this, the valve block 510 of the hydraulic system is actuated so as to retract the side wall cylinders 220 and the top panel cylinders 224. It is noted that in retracting the side wall cylinders 220 that the base or anchor points of these cylinders will also rotate such that once the cylinders have been fully retracted the entire side and top assemblies 170 will extend outwardly from the bale chamber at an inclined orientation. It is preferred that on one side of the baler, the loading side, the top panel cylinder 224 is retracted such that in this open position the top panel 174 extend in a generally coplanar relationship with the adjoining side panel 172. On the opposite side of the baler, the top panel cylinder 224 is not fully retracted. Generally on this side of the baler, the top panel cylinder 224 is actuated such that the top panel 174 extends in a generally vertical position above the adjoining side wall 172.

Figure 6:
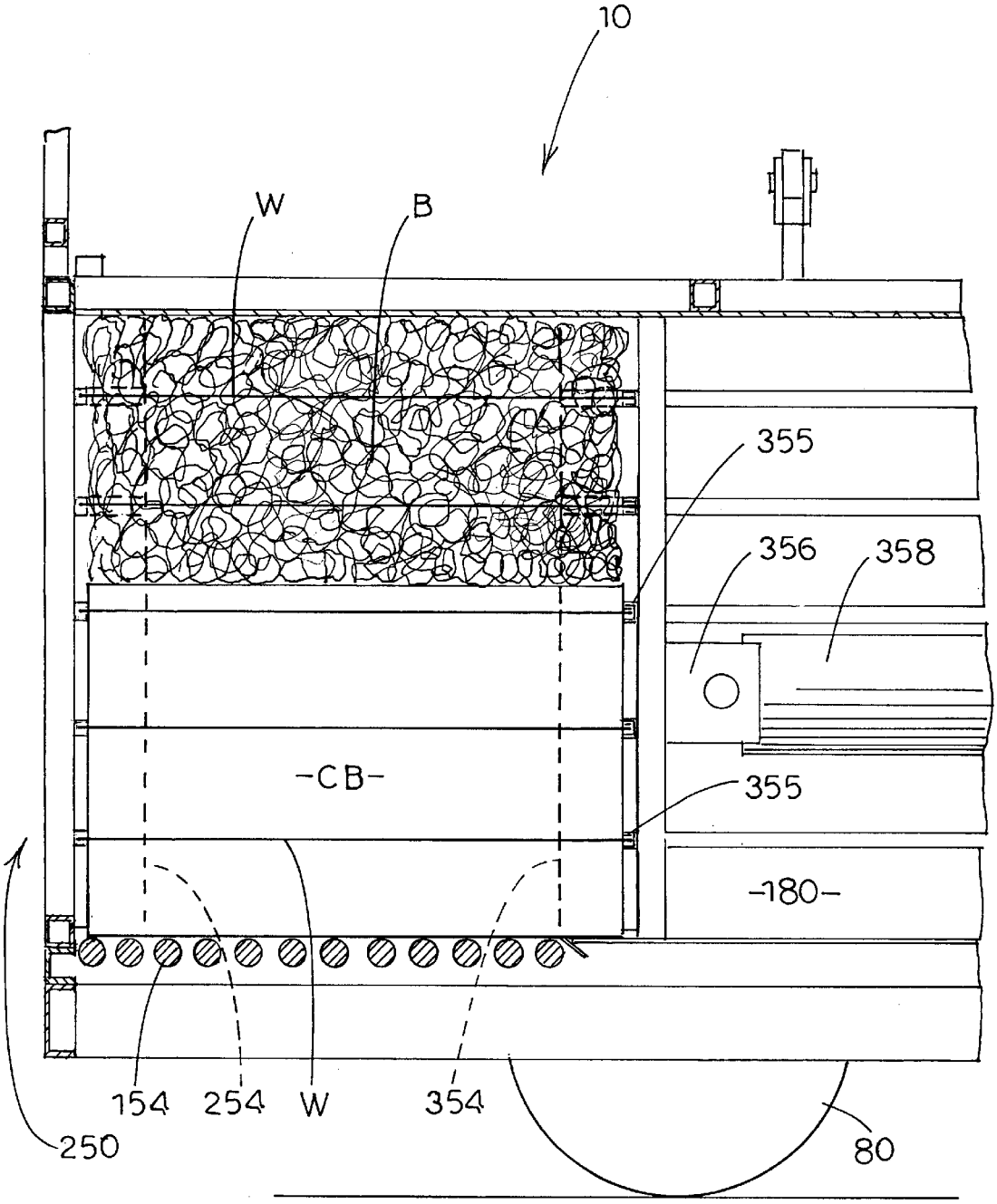
FIG. 6 is a fragmentary side elevational view of the baler with portions of the structure of the baler removed to illustrate how the ram assembly forms a bale of material within the bale chamber.

Before beginning the loading operation, it is preferred that a cardboard liner CB be placed in the bottom of the bale chamber about the exit end of the baler. This cardboard liner CB is particularly shown in FIG. 6 and as shown therein, it is seen that the cardboard liner includes a pair of sides that extends approximately midway up the sides of the baler. In addition, to stabilize the cardboard liner CB, an end flap of the liner is inserted downwardly into the floor 156 of the baler. As seen in FIG. 6, in forming the bale of the material, the material is compressed such that the formed bale B generally overlies the cardboard liner CB with the sides of the cardboard liner extending upwardly along the sides of the formed bale. After the cardboard liner CB is placed in the bale chamber, the end door 250 is closed and the latch assembly 260 is latched so as to securely fasten the end door 250 to the adjacent surrounding frame structure. In addition, before beginning the loading operation, the ram assembly 350 is retracted such that the head of the ram lies at a position generally coplanar with the front end retaining frame 100.

At this stage, the tobacco or other material can be loaded into the bale chamber 150. It will be appreciated that the material can be loaded by hand or by some form of automatic conveying means. In baling tobacco, in many situations, individuals will remove tobacco from bulk tobacco racks or containers by hand and throw the tobacco over the upper terminal edge of the top panel 174. It will be appreciated that the baling chamber could be loaded from both sides, but in most applications the bale chamber will only be loaded from one side. As tobacco is continued to be loaded into the bale chamber, it will accumulate along the floor 156 of the bale chamber and along the inner sides of the side and top assemblies 170. An operator will maintain a watch on the control panel 400 of the scales and once a predetermined weight has been loaded into the bale chamber, then the loading operation is stopped.

Next, the operator actuates the side wall cylinders 220 by extending them. That causes the side and top panel assemblies to rotate inwardly towards the bale chamber 150. Once the side and top assemblies 170 reach a generally vertical orientation, then the operator will in repeating fashion actuate the top panel cylinders 224. More particularly, the top panels 174, from both sides, will be flipped down and back a number of times to compact the tobacco or other material downwardly into the bale chamber. Once the tobacco has been adequately packed down, the top panel 174 having the lip extension 194 extending therefrom is first extended downwardly to its normal closed position. Then the other top panel 174 is rotated downwardly to where an outer terminal edge of that panel overlies the lip extension 194 of the other top panel. Now both side and top assemblies 170 are in their closed position and in that position, the side and top assemblies 170 form the sides and top of the bale chamber 150.

It is appreciated, that once the side and top assemblies 170 assume their closed position that they both interlock with the end door 250 as well as the surrounding frame 105 of the front retaining frame 100. More particularly, about the rear end of the top panels 174, there is provided a pair of top catches 306 that extend over and fasten with the two upper latches 300 that extend inwardly from the end door 250. Likewise on the opposite end, the two catches associated with the top panels 174 extend downwardly and fasten over two upper latches that extend inwardly from the surrounding frame 105 of the front retaining frame 100. Therefore, this latching arrangement effectively secures the side walls 172 in a locked vertical position. Thus during the baling operation when the ram assembly 350 is moving through the bale chamber, this lock relationship means that the side walls 172 form a fixed and rigid side structure of the bale chamber. In addition, the side wall catches 304 extend around and fasten with the two side latches 300 that project inwardly from the end door 250 as well as the two side front latches 302 (FIG. 5A) that project inwardly from the surrounding frame 105 of the end retaining frame structure 100. Thus, it is appreciated that the side and top wall structure of the baling chamber 150 is secure and interlocked with the adjacent end frame structure of the baler.

Next, the ram assembly 350 is extended causing it to move through the bale chamber 150 towards the end door 250. As the ram assembly 350 is actuated, the face of the ram assembly engages the tobacco or material within the bale chamber and pushes the material towards the end door, compressing the material in the process. At a predetermined distance, the ram assembly 350 is stopped and a bale B of tobacco or material is formed between the ram assembly 350 and the end door 250 (See FIG. 6). At this point, a series of tie wires W are extended though the baling chamber and around the formed bale of material and thereafter tied such that the compressed tobacco or other material is held in a bale formed by the wire. To accomplish this with the baler design of the present invention, one or more operators will extend individual wires W through the wire guides 355 that are formed in the head of the ram assembly 350. Once the wires W have been extended through the wire guides, the wires W are pulled around the formed bale and tied off adjacent to or outside the end door 250. It is appreciated from the drawings, that the spacing or openings formed in the side walls 172 and the end door 250, permit the wires W to be threaded around only the bale itself and not to be extended around any structure that forms the bale chamber. In particular, the end of the wires extending from the wire guides 355 are threaded around the formed bale such that the wires always extend interiorly of any structure associated with the baler. Note that the wires W can be tied off or secured together outside of the end door 250 by simply pulling the wires through the spacing that is provided between the transverse members 254 that comprise the end door 250.

After the respective tie wires W have been tied or fastened, the ram assembly 350 is slightly retracted so as to remove a substantial amount of force from against the formed bale. As the ram assembly 350 is backed off the formed bale, the bale will expand slightly and in the process the wires W will be tensioned. After the ram assembly 350 has been slightly retracted, then the operator opens the bale chamber 150 by rotating the side and top assemblies 170 to their open position. More particularly, the top panels 174 must be rotated outwardly before the entire side and top assemblies can be rotated outwardly because of the interlocked position of the top panels with the adjacent frame structure of the baler. In any event, the top panels 174 are rotated outwardly after which the entire side and top assemblies 170 are rotated outwardly to the open position. Next, the end door 250 is swung to an open position. Now the bale can be removed from the bale chamber 150 in any number of ways. For example, the ram assembly 350 can be extended such that it extends substantially entirely though the bale chamber 150, pushing the formed bale through the opening 104 formed in the rear retaining screen 102. Because of the presence of the rollers 154 formed in the floor 156 of the baling chamber, the entire bale can be pulled rather easily by hand or other mechanical means from the baling chamber.

After the bale has been removed from the baling chamber 150, then the end door 250 is closed and locked and the ran assembly retracted and consequently the baler 10 is ready to receive additional tobacco or other material to be baled.

In the embodiment illustrated herein, there is provided two opposed side and top assemblies 170. It is appreciated that the basic principles of the present invention could be achieved by simply employing one movable side and top assembly while the remaining side and top portion of the baling chamber would simply be a rigid structure and would not have the capability of moving back and forth between open and closed positions. In this same regard, if only a single moveable side and top assembly is provided, it is contemplated that the top panel that moves could form the entire top panel of the baling chamber or could simply be of the type disclosed herein where it only extended over a portion of the top of the bale chamber.

It should also be pointed out that the baler 10 could be provided with a series of four screen inserts that would be attachable or mounted to the end retaining frames 100 and 102. Each of the screen inserts would be adapted to extend outwardly and close the area between the ends of the side and top assemblies 170 and the end retaining frames 100 and 102 when the side and top assemblies assume their extended open position. This would effectively eliminate the pinch points that exist in these areas. In addition, these screen inserts could be folded inwardly against the adjacent frame structure of the baler when the baler is being transported.

From the foregoing specification and discussion, it is appreciated that the present invention presents an automatic baling machine for baling tobacco and other materials that is very efficient and easy to load. The fact that at least one side and top assembly 170 of the baling chamber can be moved to an open position where the baler can be loaded from the top results in a very efficient loading operation. Also once the side and top assembly 170 assumes the open position, the upper terminal edge of the top panel 174 is located at a height that enables individuals to easily load the tobacco or material over the top edge of the top panel 174. Also the fact that the baler 10 is portable provides additional advantages. The farmer can easily move the baler from one barn to another, as opposed to having to transport the tobacco from each barn to a stationary baler.

The present invention may, of course, be carried out in other specific ways than those herein set forth without departing from the spirit and the essential characteristics of the invention. The present embodiments are therefore to be construed in all aspects as illustrative and not restrictive and all changes coming within the meaning and equivalency range of the appended claims are intended to be embraced therein.

What is claimed:

1. A baler for baling material comprising: a main frame; a baling chamber having a pair of opposed side and top assemblies with each side and top assembly being movable from an open position to a closed position where the side and top assemblies form a part of the baling chamber, and wherein in the open position the baling chamber is itself open such that material may be fed into the baling chamber; each side and top assembly including a side wall and a top portion; a first hinge pivotally connecting the side wall of each side and top assembly to the baler; a second hinge interposed between the side wall an top portion of each side and top assembly for permitting the side wall and top portion to pivot with respect to each other; and a ram reciprocally mounted for movement back and forth within the bale chamber.

2. The baler of claim 1 including a door disposed opposite the ram and moveable between open and closed positions, and wherein in the closed position the door forms a part of the baling chamber and acts to retain the product being baled as the ram moves towards the closed door, and wherein in the open position a formed baled product can be removed from the baling chamber.

3. The baler of claim 2 wherein the door and side and top assemblies all interlock when they assume closed positions.

4. The baler of claim 3 wherein there is provided a series of latches that project from the door and wherein the side wall and top portions of the side and top assemblies include catches for interlocking with the latches of the door.

5. The baling of claim 4 including an end retaining structure extending upwardly adjacent the baling chamber opposite the door and wherein the side and top assemblies are interlocked with the end retaining structure.

6. The baler of claim 5 wherein the end retaining structure includes an opening formed therein for permitting the ram assembly to move through the opening during a baling operation.

7. The baler of claim 6 wherein the ram assembly includes a front face for engaging the product being baled and a guide structure that extends from the ram assembly opposite the front face.

8. The baler of claim 1 wherein the baling chamber includes a bottom and wherein when the opposed side and top assemblies assume the closed position, the baling chamber assumes an elongated configuration with opposed open ends; and wherein there is provided an end door disposed adjacent one open end and the end door is moveable between open and closed positions so as to close one end of the baling chamber; and wherein the opposite open end of the baling chamber functions to permit the ram to move therethrough during the baling operation.

9. The baler of claim 1 wherein the top portions of the side and top assemblies cooperate to form the top of the baling chamber when the side and top assemblies assume the closed position.

10. The baler of claim 9 wherein one top portion of one side and top assembly includes an extension lip that extends underneath the other top portion of the other side and top assembly when the two side and top assemblies assume the closed position.

11. The baler of claim 1 wherein the baling chamber includes a bottom and a series of rollers disposed within a portion of the bottom that facilitates the removal of a baled product from the baling chamber.

12. The baler of claim 1 including a pair of hydraulic cylinders for driving each side and top assembly, one hydraulic cylinder anchored to the main frame and connected to a side wall and the other hydraulic cylinder anchored to the side wall and connected to the top portion for moving the top portion with respect to the side wall.

13. A method of baling tobacco comprising:

a. providing a baler having a baling chamber formed in part at least by a side and top assembly, the side and top assembly including a side panel and a top panel, and wherein the side and top assembly is pivotally mounted to the baler adjacent the baling chamber while the top panel is pivotally mounted to the side panel;

b. pivoting the side and top assembly to an open position so as to leave a top portion of the baling chamber open;

c. transferring tobacco through the open top portion of the baling chamber;

d. pivoting the side and top assembly from the open position to a closed position where the side and top assembly form a part of the baling chamber; and e. moving a ram through the baling chamber and engaging the tobacco therein and compressing the tobacco to form a bale of tobacco.

14. The method of claim 13 wherein in pivoting the open position the top panel is pivoted relative to the side panel while the side panel is pivoted from a generally vertical position to an outer inclined position.

15. The method of claim 14 wherein in the open position the top and side panels are generally aligned such that they assume a generally coplanar relationship.

16. The method of claim 13 wherein the baling chamber includes opposed end structures and interlocking the side and top assembly with the opposed end structures when the side and top assembly assumes the closed position and forms a part of the baling chamber.

17. The method of claim 13 wherein the baling chamber is formed in part at least by two opposed side and top assemblies with each being movable from an open position to a closed position, and wherein in the open position both assemblies are extended outwardly from the baling chamber so as to form an open side and top area for delivering tobacco into the baling chamber, and wherein in the closed position both assemblies form the opposed sides and top of the baling chamber.

18. The method of claim 17 wherein the baling chamber includes opposed end structures and wherein the closed position the method entails interlocking both side and top assemblies with opposed end structures.

19. The method of claim 18 wherein one end structure includes an openable end door that is moveable between closed and open positions, and in the closed position the door forms a part of the baling chamber and wherein in the open position a formed tobacco bale can be removed from the baling chamber.

20. The method of claim 19 wherein the baling chamber includes an open end opposite the door and wherein the ram moves through the open end of the baling chamber and is operative to compress tobacco against the door and into a baling within the baling chamber.

21. The method of claim 20 wherein the ram is operative during one stroke to compress tobacco between the ram and the closed door and is operative in a second stroke to eject the formed bale from the baling chamber when the door assumes an open position.

22. The method of claim 21 wherein in the closed position the door is operative to interlock with the opposed side and top assemblies when they assume the closed position.

23. The method of claim 22 wherein the opening formed in the end of the baling chamber opposite the door includes a surrounding frame structure and wherein in the closed position the opposed side and top assemblies interlock with the surrounding frame structure such that the opposed side and top assemblies are interlocked at opposite ends of the baling chamber.

24. The method of claim 13 including moving a formed tobacco bale from the baling chamber by moving the tobacco bale over a series of rollers formed in a bottom area of the baling chamber.

25. The method of claim 24 wherein the baling chamber includes an end door that is movable between open and closed positions about one end of the baling chamber and wherein the rollers are disposed in a floor area of the baling chamber adjacent the end door.

26. The method of claim 25 wherein the ram is operative to eject a bale from the baling chamber by pushing the formed tobacco bale over the rollers and out an end opening of the baling chamber when the end door assumes an open position.

27. A baler for baling material comprising:

a. a main frame;

b. a baling chamber disposed on the main frame and including:

i. a bottom;

ii. a pair of longitudinally spaced end frame structures with each end frame structure including an opening aligned with the baling chamber;

iii. an end door mounted to one of the end frame structures and movable between an open and closed position and wherein in the closed position the end door forms an end of the baling chamber;

iv. a surrounding side and top structure that together with the bottom form a longitudinal section of the baling chamber;

v. the surrounding side and top structure including at least one side and top assembly that is movable between closed and open positions wherein in the open position the side and top assembly extends outwardly from the baling chamber and defines an open top feed area that enables feed material to be fed into the baling chamber;

vi. the at least one side and top assembly includes a side panel and a top panel, and wherein the side and top panels are movable together relative to the baling chamber while the top panel is movable relative to the side panel; and c. a ram reciprocally mounted for movement back and forth through the baling chamber, the ram being operative to move toward the end door when it assumes a closed position and to compress material between the ram and the end door to form a compressed bale of material.

28. The baler of claim 27 wherein the at least one side and top assembly is hydraulically powered and the side and top panels are movable and actuated by one hydraulic cylinder while the top panel is movable and actuated relative to the side panel by a second hydraulic cylinder.

29. The baler of claim 28 including an interlock structure for interlocking the side and top assembly with the end door when the side and top assembly and end door assume the closed positions.

30. The baler of claim 27 wherein the surrounding side and top structure includes a second side and top assembly that is movable between open and closed positions and wherein in the open position the second side and top assembly extends outwardly from the baling chamber so as to form an enlarged opening for feeding material into the top of the baling chamber, and wherein in the closed positions the first and second side and top assemblies effectively join together to form the sides and top of the baling chamber.

31. The baler of claim 27 including a pair of transverse retainers that extend across opposite ends of the baling chamber for retaining material being fed into the baling chamber when the side and top assembly assumes the open position.

32. The baler of claim 31 wherein the transverse retainer extends outwardly past at least one side of the baling chamber when the side and top assembly assumes the closed position.

33. The baler of claim 31 wherein the pair of transverse retainers are integral with the longitudinally spaced end frame structures.

34. A baler for baling material comprising:

a baling chamber having a surrounding side and top wall structure including a pair of sides and a top, a bottom and a closed end; a reciprocal ram mounted opposite the closed end of the baling chamber and movable through the baling chamber for compressing material between the ram and the closed end of the baling chamber so as to form a bale of material between the closed end and the ram; wherein at least one side and top of the baling chamber form a movable side and top portion which are movable together relative to the baling chamber between a closed position and an open position, and the top is separately movable relative to the one side; and wherein in the closed position the movable side and top portion actually forms a part of the side and top wall structure of the baling chamber and wherein in the open position a side and top opening is formed in the baling chamber that permits material to be loaded into the baling chamber.

35. The baler of claim 34 including a pair of hydraulic cylinders connected to the movable side and top portion of the baling chamber with one cylinder being operative to move both the side and top portion together and with the other cylinder being operative to move the top with respect to the side.

36. The baler of claim 34 wherein when the moveable side and top portion assume a closed position the formed baling chamber is generally elongated and wherein the opposed sides lie generally normal to both the top and bottom of the baling chamber.

37. The baler of claim 36 wherein the end includes an end door that is movable between open and closed position and wherein the end door assumes a closed position when the ram acts to form a bale.

38. The baler of claim 34 including interlocking structure for locking the movable side and top portion to the other structure that forms the bale chamber.

39. A baler for baling material comprising: a baling chamber having a surrounding side and top wall structure including a pair of sides, a top and a bottom; a reciprocal ram mounted in the baling chamber and moveable through the baling chamber for compressing material; and wherein at least a portion of one side is moveable between an open and closed position and wherein at least a portion of the top is pivotally connected to one side of the baling chamber and moveable back and forth relative to the one side of the baling chamber that the top is pivotally connected to.

40. A baler for baling material comprising:

a. a main frame;

b. a baling chamber disposed on the main frame and including:

i. a bottom;

ii. a pair of longitudinally spaced end frame structures with each end frame structure including an opening aligned with the baling chamber;

iii. a surrounding side and top structure that together with the bottom form a longitudinal section of the baling chamber;

iv. the surrounding side and top structure including at least one side and top assembly that is movable between closed and open positions wherein in the open position the side and top assembly extends outwardly from the baling chamber and defines an open top feed area that enables feed material to be fed into the baling chamber;

c. a ram reciprocally mounted for movement back and forth through the baling chamber, the ram being operative to move toward the end door when it is assumes a closed position and to compress material between the ram and the end door to form a compressed bale of material; and d. a pair of transverse retainers that extend across opposite ends of the baling chamber for retaining material being fed into the baling chamber when the side and top assembly assumes the open position.

* * * * *